US007712241B2

(12) United States Patent
Teetzel et al.

(10) Patent No.: US 7,712,241 B2
(45) Date of Patent: May 11, 2010

(54) HAND GRIP APPARATUS FOR FIREARM

(75) Inventors: James W. Teetzel, York, ME (US); Gary M. Lemire, Lee, NH (US)

(73) Assignee: Wilcox Industries Corp., Newington, NH (US)

( * ) Notice: Subject to any disclaimer, the term of this patent is extended or adjusted under 35 U.S.C. 154(b) by 868 days.

(21) Appl. No.: 11/084,942

(22) Filed: Mar. 21, 2005

(65) Prior Publication Data

US 2005/0241206 A1 Nov. 3, 2005

Related U.S. Application Data

(60) Provisional application No. 60/555,279, filed on Mar. 22, 2004.

(51) Int. Cl.
*F41C 23/00* (2006.01)

(52) U.S. Cl. ..... 42/72; 42/94; 248/171

(58) Field of Classification Search ..... 42/72, 42/94; 248/171; 89/37.03, 37.04
See application file for complete search history.

(56) References Cited

U.S. PATENT DOCUMENTS 3,632,073 A * 1/1972 Nakatani ..... 248/169
4,121,799 A * 10/1978 Michio ..... 248/171
D276,621 S * 12/1984 Hanke ..... D16/244
4,915,332 A * 4/1990 Ouellette ..... 248/171
5,628,135 A * 5/1997 Cady ..... 42/94
6,007,032 A * 12/1999 Kuo ..... 248/185.1
6,283,421 B1 * 9/2001 Eason et al. ..... 248/170
6,487,807 B1 * 12/2002 Kopman et al. ..... 42/94
6,785,997 B2 * 9/2004 Oz ..... 42/94
7,111,424 B1 * 9/2006 Moody et al. ..... 42/72
7,121,034 B2 * 10/2006 Keng ..... 42/71.01
7,454,858 B2 * 11/2008 Griffin ..... 42/71.01
2007/0271832 A1 * 11/2007 Griffin ..... 42/72

* cited by examiner

*Primary Examiner*—Troy Chambers
(74) *Attorney, Agent, or Firm*—McLane, Graf, Raulerson & Middleton, Professional Association

(57) ABSTRACT

A handgrip apparatus for firearm includes a hollow housing defining a handgrip surface and forming an enclosure. A fastener is connected to the housing for removably attaching the handgrip apparatus to a fore-end portion of a firearm. A retractable leg assembly is movable between a retracted position and an extended position and includes a pair of pivoting legs usable as a bipod support when the leg assembly is in the extended position.

15 Claims, 7 Drawing Sheets

HAND GRIP APPARATUS FOR FIREARM

CROSS-REFERENCE TO RELATED APPLICATION

This application claims the benefit under 35 U.S.C. §119 (e) of U.S. provisional application Ser. No. 60/555,279 filed Mar. 22, 2004. The aforementioned provisional application is incorporated by reference in its entirety.

FIELD OF THE INVENTION

The present invention relates to a combination hand grip and bipod for firearm, as well as a method of supporting a firearm using same. The present invention is convertible between a hand grip and a bi-pod or rest, and finds wide utility for use in connection with firearms, including without limitation, military and police use and training, hunting, target shooting, and the like.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENT

Figure 1:
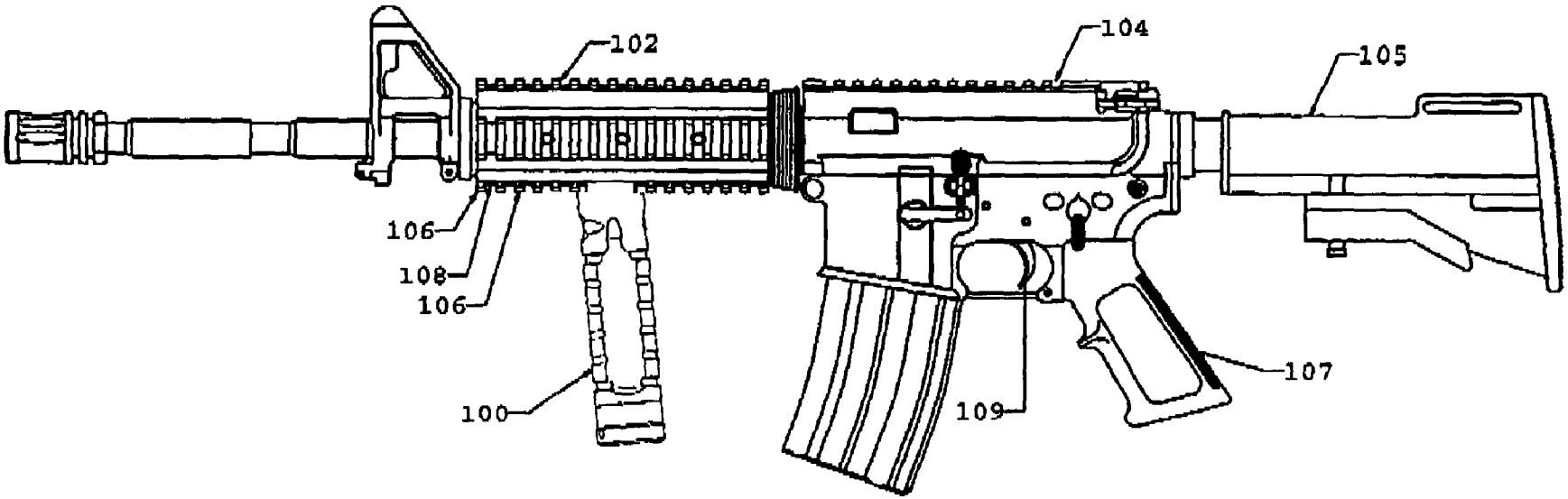
FIGS. 1 and 2 illustrate the removable hand grip according to an embodiment of the present invention, which is shown attached to a weapon via an accessory mount rail interface, such as a Picatinny rail interface, wherein the extendable legs are retracted for use in standard operation.
Figure 2:
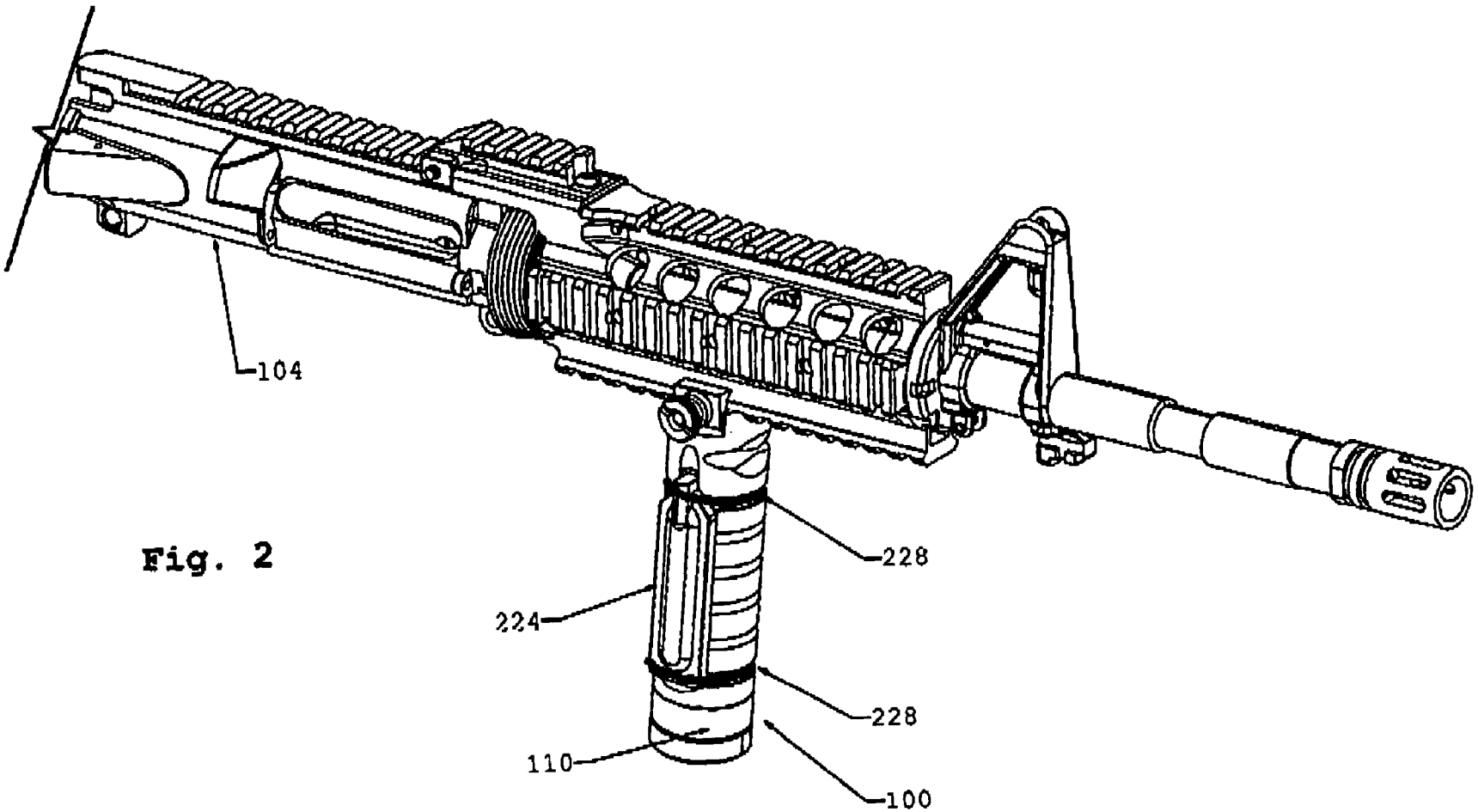
Figure 5:
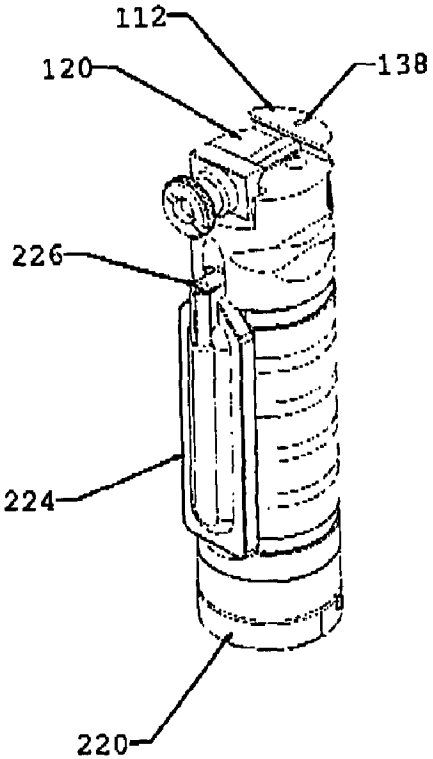
FIGS. 3, 4, and 5 are front, side, and perspective views of the hand grip apparatus embodiment of FIGS. 1 and 2, wherein the legs are in the retracted position.
Figure 3:
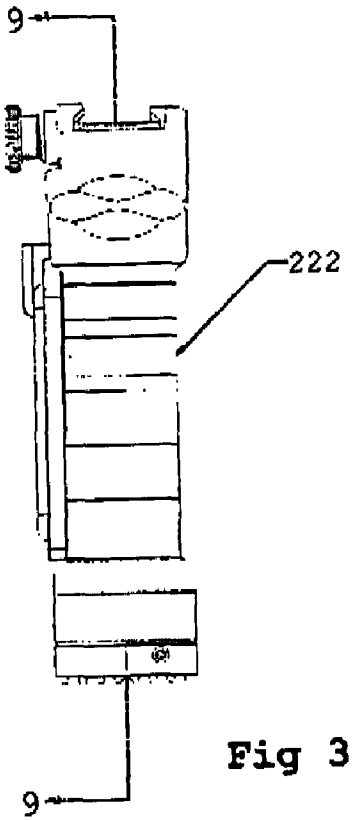
Figure 4:
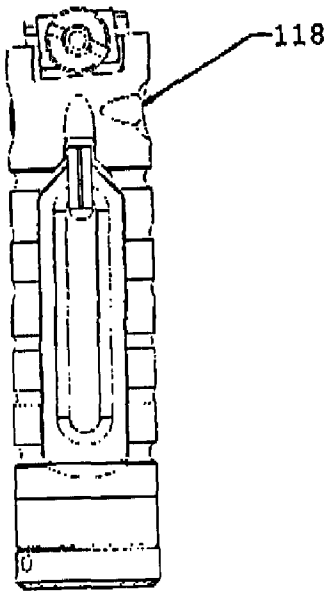

Referring to the drawing figures, a hand grip apparatus 100 is provided which may be mounted to an accessory rail interface assembly 102 of a weapon 104 of a type having a butt stock 105 and a rear pistol grip 107 adjacent a trigger 109. Although the embodiment depicted in FIGS. 1 and 2 is shown attached to the fore portion of an M4A1 rifle having a Picatinny rail interface (e.g., as specified in MIL-STD-1913), it will be recognized that the present invention may be adapted for use with all manner firearms, including without limitation rifles, handguns, machine guns, mortars, etc., and all manner of weapon accessory mount rail interfaces or mounting systems.

Figure 8:
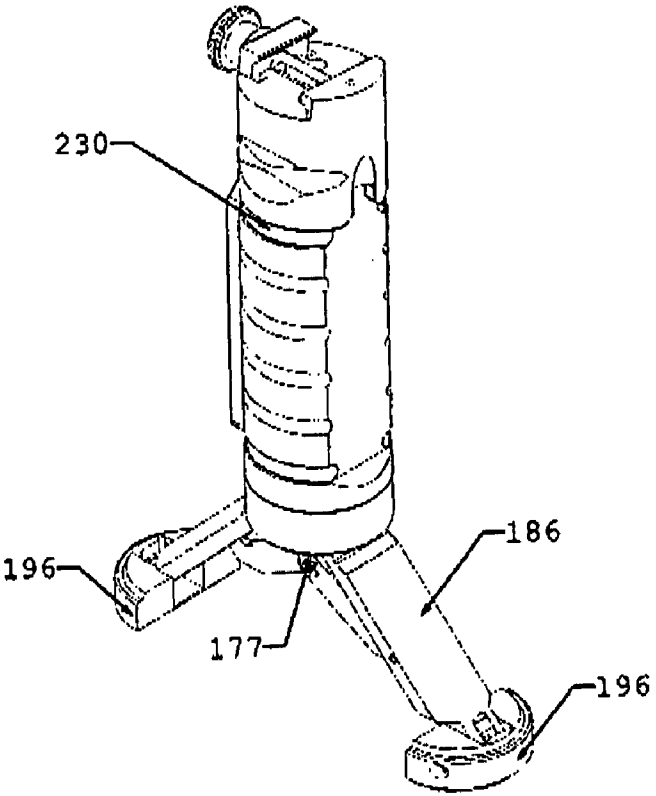
FIGS. 6, 7, and 8 are front, side, and perspective views of the hand grip apparatus embodiment of FIGS. 1 and 2, wherein the legs are in the extended position for supporting the barrel or stock of a firearm on a generally horizontal surface. In a preferred aspect, the support surface may be the ground, e.g., for so-called "over-the-beach" targeting or wherein the user is otherwise in a prone position.
Figure 6:
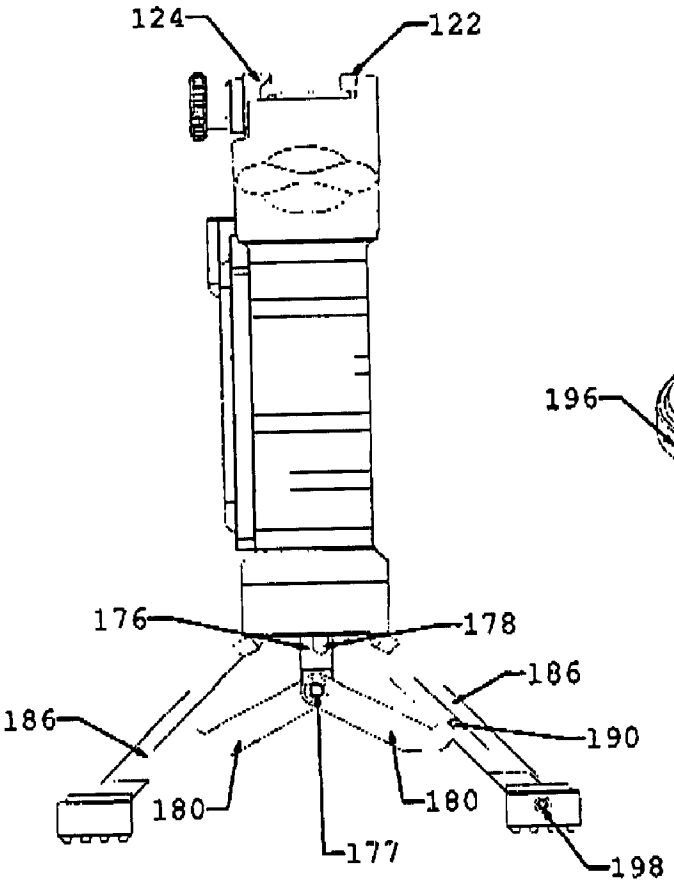
Figure 7:
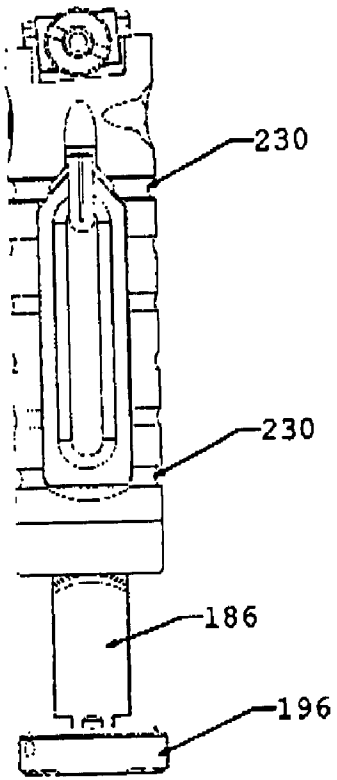

The hand grip 100 converts between a hand grip mode of operation and a bi-pod mode of operation. In the handgrip mode of operation, the handgrip 100 is used as a conventional generally vertical hand grip (see FIG. 1), e.g., wherein (for a right-handed marksman) the handgrip 100 is grasped by the left hand and the pistol grip 107 is grasped by the right hand, with the butt stock 105 held against the right shoulder. In the bi-pod mode of operation, the hand grip device 100 functions as a gun rest to support the front of the weapon above a support surface during targeting or shooting operations (see FIGS. 6-8). While the bi-pod legs of the depicted embodiment may advantageously be employed to support the fore end of a firearm on the ground by a user in a prone position, it will be recognized that the support legs may be used to support a firearm on any generally horizontal surface on which is may be desired to support a firearm, such as tabletops, benches, floors, the ground, pavement, and the like.

The hand grip 100 extends generally perpendicular to the rail interface, and in a preferred embodiment, is angled toward the user to minimize bending of the user's wrist, preferably about 3-12 degrees with respect to the barrel, and more preferably about 5 degrees. As used herein, the term "vertical hand grip" is not intended to preclude such variations.

The hand grip 100 includes a hand grip housing 110, a rail clamp assembly 112, a retractable leg assembly 114. A latch release assembly 116 is mounted within the housing 110.

The housing 110 may be made of any rigid material, and in a preferred embodiment is made from aluminum, more preferably light weight aircraft aluminum. The hand grip assembly may include circumferential grooves, ridges, knurls, or other hand grip features. Also, the housing 110 may be textured, e.g., via sandblasting, to improve grip. In the depicted embodiment, an optional recess 118 is provided on the front side of the housing 110 for receiving the user's index finger. Optionally, additional finger recesses for additional fingers may also be provided. Optionally, a soft or resilient material (not shown) may be provided on the exterior of housing 110.

The hand grip 110 may be generally tubular and is closed at a first end 120 which is proximal to the mounting rail 102 when mounted on a weapon. The rail clamp assembly 112 (which can best be seen in FIG. 11) includes a first rail grabber 122 which is preferably permanently attached to the housing 110 and which is preferably integrally formed therewith. A second rail grabber 124 is mounted on a threaded rod 126, which is mounted on the proximal end 120 of the housing 110. The threaded rod 126 passes through an opening 128 in the second rail grabber 124 and is received within an opening 130 in the first rail grabber 122. The threaded rod 126 partially rests in a groove 132 formed on the housing end 120 and is secured via a fastener 138, such as a threaded fastener, passing through the first rail grabber, the threaded rod, and into the housing 110. The second rail grabber 124 is moveable along the threaded rod 126.

In operation, the first and second rail grabbers 122 and 124 are placed on opposite transverse sides of a rail to be mounted and cooperate to removably secure the apparatus 100 to a rail interface. An internally threaded nut 134 may be rotated about the threaded rod 126 to urge the second rail grabber toward the first rail grabber to provide a clamping action about the rail interface (102). The threaded interface depicted includes an alternating series of protrusions 106 and recesses 108 (see FIG. 2).

When mounted, the threaded rod 126 extends into a selected one of the recesses 108 (selected in accordance with a user's desired longitudinal position of the hand grip 110 on the weapon 102) to further secure the hand grip 110 to the accessory rail and prevent any movement there along. In the depicted embodiment, the threaded rod 126 includes a shaped portion 127 complimentary with the recesses 108. It will be recognized that the fastening system may be modified to accommodate other rail interface systems.

In the preferred embodiment shown, the nut 134 rotates relative to the threaded rod 126. Optionally, a protrusion on the threaded rod 126, a threaded fastener or lug (not shown), or other means for preventing complete removal of the nut 134 from the threaded rod 126 may be provided.

The latch assembly 116 is mounted interiorly within the proximal end of the housing 110. The latch assembly 116 is secured within the housing 110 via one or more threaded fasteners 140. The latch assembly 116 includes a latch member 142 slideably captured between a first and second latch assembly housing members 144 and 146, respectively. Each of the first and second latch assembly housing members 146 and 144 include aligned openings 148 and 150 passing therethrough. The latch member 142 includes a push button 152 which passes through an opening 153 in the housing 110, preferably disposed at a position the opposite the grip recess 118. The latch member 142 includes an opening 154. A spring 156 is captured between the latch housing members 146 and 144 and urges the latch member 142 outwardly such that the opening 154 is urged out of alignment with the openings 148 and 150. Pressing the button 152 against the bias of the spring 156 brings the opening 154 into alignment with the openings 148 and 150 thereby releasing the leg mechanism 114 as will be described in further detail below. In certain embodiments, the latch release button 156 is located at a position on the handgrip surface so as to be accessible by an operator's thumb when the operator's hand is closed about the housing.

Figure 10:
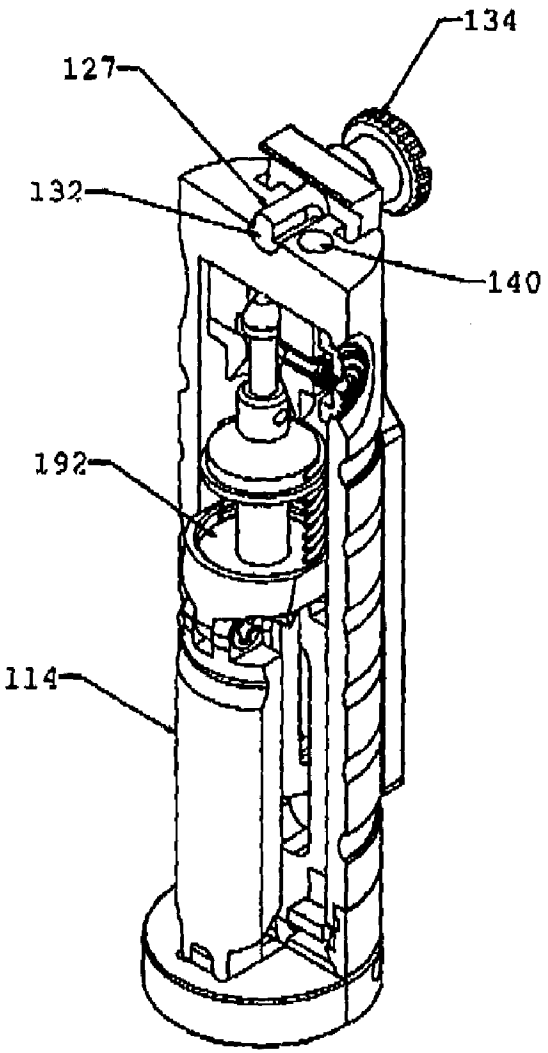
FIG. 10 is a fragmentary illustration showing the latch and leg assemblies.
Figure 9:
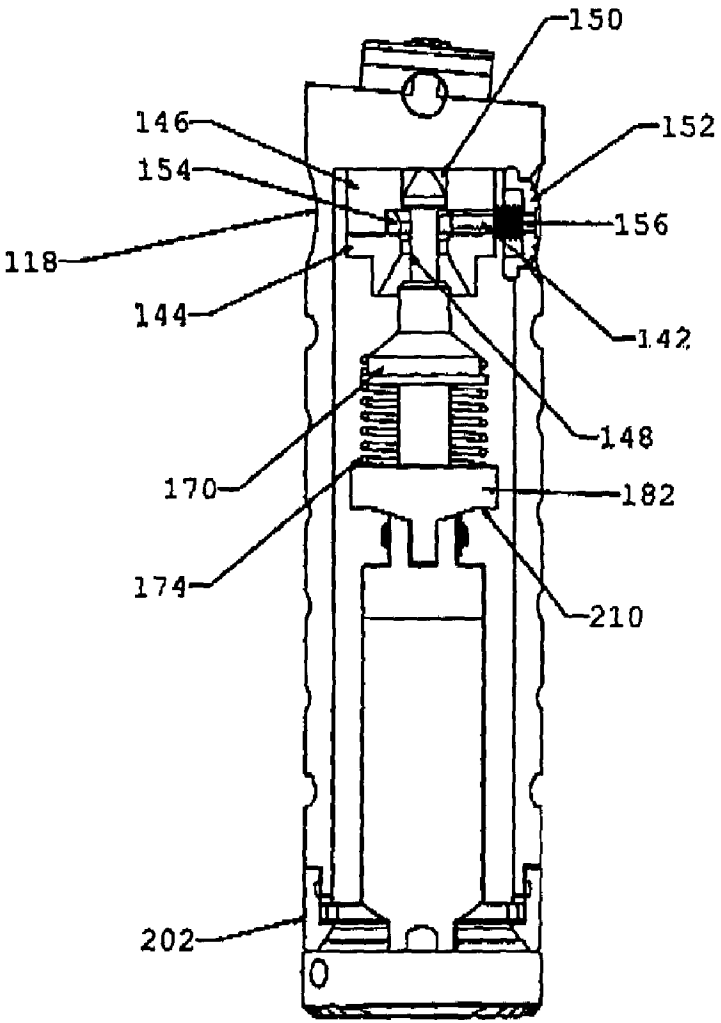
FIG. 9 is a side sectional view of the latch release assembly taken along the lines 9-9 shown in FIG. 3.

As can best be seen in FIGS. 9 and 10, which shows the leg assembly 114 retracted and engaging the latch assembly 116, the leg assembly 114 includes a locking pin 160 which passes through the openings 148, 154, and 150 of the latch assembly 116. The pin 160 includes a tapered or generally conical end 162. The end 162 includes a base flange 164 which may engage the 15 upper surface of the latch member 142 to prevent passage therethrough unless the push button 152 is depressed by the user to bring the opening 154 into alignment with openings 150 and 148. On the lower surface of the latch 142, the peripheral edge of the opening 154 may be countersunk, beveled, rounded, etc., so as to cooperate with the tapered end 162 of the pin 160 to facilitate passage of the tapered end 162 of the pin 160 in the upward (in the orientation shown) direction.

The pin 160 passes through a central opening in a spring flange 170 and may be secured by a fastener such as a retaining pin 172. A coaxial spring 174 engaging the spring flange 170 and latch assembly housing base 144 is compressed when the leg assembly 114 is in the retracted position. The compression of the spring 174 causes the leg assembly 114 to be urged downward into the extended or open position (see FIG. 2) when the button 152 is depressed, thus bringing the opening 154 into alignment with the openings 150 and 148. To retract the bipod legs, the legs are simply collapsed and reinserted into the housing 110, against the bias of the spring 174, wherein the pin 160 engages the latch assembly 116 as described above.

The spring flange 170 is mounted on the upper end of an axial rod 176, which may be integrally or separately formed with the spring flange 170. The rod 176 includes an elongated opening 178. Two leg spreader arms 180 are pivotally attached to the lower end of the rod 176 and pivot about pivot pin 177. A leg mounting member 182 includes first and second hinge members 184, to which are hingedly attached to first and second legs 186. Legs 186 pivot about pivot pins 188 between a retracted or closed position and an extended or open position. The spreader/brace members 180 also pivotally attach to an inward facing side of the legs 186 at pivot point 190. The pivotal attachment of the spreader arms 180 can best be seen in FIG. 11.

The base of the spring flange 170 rests within a recess 192 formed on the upper surface of the leg mounting member 182 when the legs are fully extended. The leg mounting member 182 acts as a stop, limiting the pivoting range of motion of the legs 186. A pin 194 is secured to the leg mounting member 182 and passes through the elongate opening 178 to capture the spring flange 170. The retaining pin travels generally confined to the length of the elongate opening 178 when the legs are moved between the extended and retracted positions. The legs 186 are pivotally attached at their lower ends to pivoting feet 196. Each of the feet 196 pivot about a respective pivot pin 198. Springs 200 are provided to pivotally urge the feet into a closed position (see FIG. 11, thereby maintaining the feet within the overall footprint of the hand grip when the feet are retracted. When the legs are extended, and placed on a support surface, the weight of the weapon causes the feet to pivot against the bias of the springs 200 to align the feet with the support surface. The feet 196 may be made of any suitable material, including plastics, composite materials, metals, and so forth. The lower surface of the feet 196 may be grooved or otherwise textured to prevent slippage on the support surface.

Figure 11:
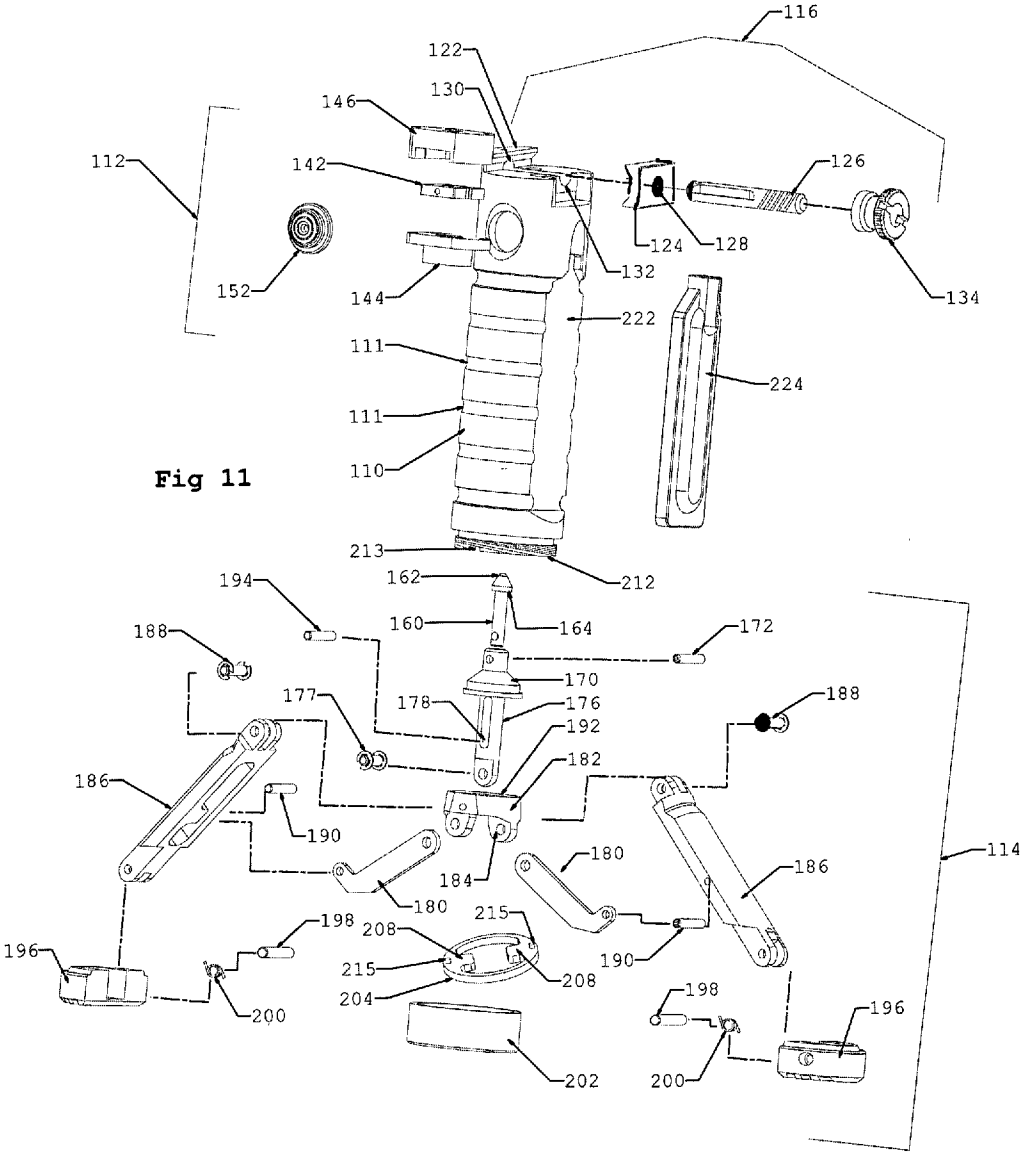
FIG. 11 is an exploded view of the handgrip apparatus.

An internally flanged base member 202 (as best seen in FIG. 11) is secured to the distal housing end 220 to provide retention of the leg assembly 114 within the housing 110 when the leg assembly 114 is in the open position. A stop member 204 received within the base member 202 includes two oppositely disposed stops 208 extending inwardly. The underside surface 210 of the leg mounting member 182 abuts the stop member 204 when the legs are in the fully open position. The stop members 208 allow a desired degree of rotation of the leg assembly relative to the housing portion 110. The relative rotation permits the weapon to be horizontally pivoted to engage the target without the need to move or shift the feet relative to the underlying support surface. The legs 186 and/or leg hinge members 184 cooperate with the stop members to limit range of rotation. The stop members 208 may be sized and/or configured to permit some desired or predetermined degree of rotation.

The stop member 204 and the distal housing end may include aligned or mating surface features to retain the stop member 204 at the desired orientation with respect to the housing and to prevent relative rotation of the stop member 204 relative to the housing 110. In the preferred embodiment, one or more (two in the illustrated embodiment) protrusions or bosses 215 on the stop member 204 engage complimentary grooves or depressions 213 formed on the housing 110. Alternatively, one or more protrusions may be formed on the housing 110 and complimentary aligned openings or depressions may be formed on the stop member 204. Other means for aligning and preventing rotation of the stop member 204 are also contemplated, such as a "keyed" peripheral shape which is complimentary with a corresponding feature on the housing 110 distal end 220.

The base ring 202 may be secured to the housing via any of a number of means. For example, the base ring 202 may contain internal threads which mate with threads 212 provided on the distal housing end 220. Alternatively or additionally, other fasteners such as set screws, adhesives, clips, dogs, pawls, or the like, or combinations thereof, may be used.

Figure 12:
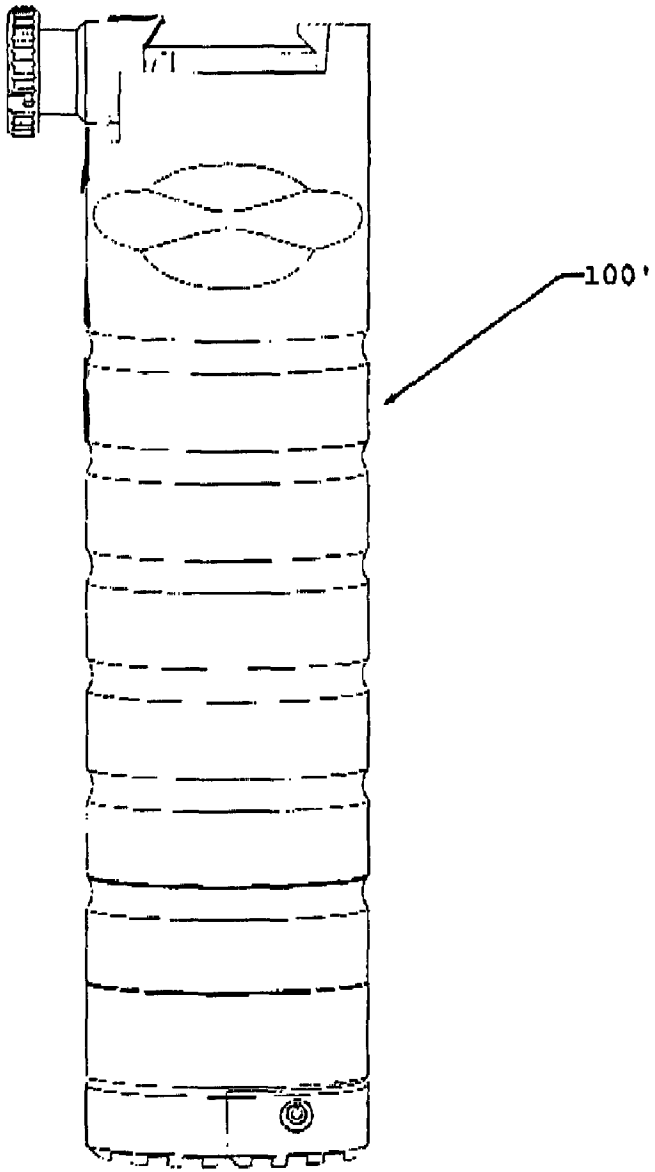
FIG. 12 illustrates a handgrip apparatus according to a second embodiment.

In the depicted embodiment, the handgrip housing 110 includes optional surfaces or recesses 222 for receiving an optional switch 224. An alternative handgrip apparatus embodiment 100' which is generally as described above by way of reference to the handgrip apparatus 100, but which lacks the switch 224 and switch mounting surface 222 is shown in FIG. 12.

The switch 224, which may be a mechanical contact switch, is provided for actuating an electronic accessory mounted on the weapon 104, such as a laser sight module, light source for target illumination, or other electronically operated accessory. The switch 224 includes a connector 226 for removably electrically coupling the switch 224 to the accessory. In one embodiment, the switch 224 includes normally open contacts and is resiliently depressible to close the contacts for actuating an attached accessory, although other switch configurations are also contemplated.

In the depicted preferred embodiment, the handgrip housing includes mounting surfaces 222 on opposite transverse sides of the handgrip surface for left- or right-side mounting. In the depicted embodiment, the switch 224 may be removably attached to the housing 110 by bands, cables, ties, etc., 228 encircling the handgrip housing 110 and switch member 224. The bands 228 engage grooves or recesses 230 formed in the housing 110. Of course, other fastener types may be employed, such as clips, clasps, adhesive fasteners, or snap-fit or otherwise complimentary mating features formed on the housing 110 and switch 224.

In the embodiment illustrated in FIG. 1, the switch 224 appears on the right side of the handgrip housing 110. In operation, the left hand of a right-handed marksman is closed about the handgrip housing 110 such that the user's fingertips are on the switch 224. The laser sighting module or other accessory may then be actuated by increasing the gripping force by an amount sufficient to close the contacts. It will be recognized that other switch types and configurations may be employed.

The invention has been described with reference to the preferred embodiments. Modifications and alterations will occur to others upon a reading and understanding of the preceding disclosure herein, whereby it is to be distinctly understood that the foregoing descriptive matter is to be interpreted merely as illustrative of the invention and not as a limitation.

Having thus described the preferred embodiments, the invention is now claimed to be:

1. A handgrip apparatus for firearm, comprising:

a hollow housing having a longitudinal axis and defining a handgrip surface and forming an enclosure;

a fastener connected to the housing for removably attaching the handgrip apparatus to a fore-end portion of a firearm;

a retractable leg assembly movable between a retracted position and an extended position, said leg assembly including a pair of pivoting legs received within said hollow housing when the leg assembly is in the retracted position and usable as a bipod support when the leg assembly is in the extended position; and said leg assembly axially rotatable relative to said hollow housing about the longitudinal axis of said hollow housing.

2. The handgrip apparatus of claim 1, further comprising:

a stop member secured to the housing and cooperating with said leg assembly to limit axial rotation of the leg assembly relative to the hollow housing to a predetermined range.

3. The handgrip apparatus of claim 1, further comprising:

a switch exteriorly positioned on said handgrip surface.

4. The handgrip apparatus of claim 3, wherein said switch is positioned on said handgrip surface so as to be accessible by an operator's fingertips when the operator's hand is closed about the handgrip housing.

5. The handgrip apparatus of claim 4, further comprising:

said handgrip surface having a surface feature complimentary with a surface of said switch.

6. The handgrip apparatus of claim 4, further comprising:

said switch selectively positionable at a plurality of locations on said handgrip surface.

7. The handgrip apparatus of claim 4, further comprising:

said switch selectively positionable at a first location on said handgrip surface to accommodate a right-handed operator and a second location on said exterior handgrip surface to accommodate a left-handed operator.

8. The handgrip apparatus of claim 7, further comprising one or more fasteners for securing said switch to said housing.

9. The handgrip apparatus of claim 8, wherein said one or more fasteners includes one or bands encircling the housing and the switch.

10. The handgrip apparatus of claim 3, wherein said switch includes an electrical connector for removably electrically connecting said switch to a weapon-mounted accessory.

11. The handgrip apparatus of claim 10, wherein said switch is for actuating a weapon-mounted accessory selected from a laser sight module and a light source for target illumination.

12. The handgrip apparatus of claim 1, further comprising:

a latch assembly for releasably securing the leg assembly in the retracted position;

a depressible latch release actuator to allow said leg assembly to be moved to the extended position; and spring means in said housing for urging said leg assembly to said extended position when said latch release actuator is depressed.

13. The handgrip apparatus of claim 12, wherein said latch release actuator is located at a position on said handgrip surface so as to be accessible by an operator's thumb when the operator's hand is closed about the housing.

14. The handgrip apparatus of claim 13, further comprising:

an axially movable member coupling said latch assembly to said leg assembly, said axially movable member movable in an axial direction when the leg assembly is moved between the retracted and extended positions;

said axially movable member including an elongate slot;

a stop member affixed to said leg assembly and extending into said elongate slot, said stop member and said elongate slot cooperating to limit a range of axial movement of said axially movable member relative to said leg assembly; and;

a pair of spreader arms, each of said spreader arms pivotally attached at a first end to said axially movable member and pivotally attached at a second end opposite the first end to a respective one of said legs.

15. The handgrip apparatus of claim 14, further comprising:

a pair of pivoting feet, each of said pivoting feet attached to a distal end of a respective one of said pivoting legs.

* * * * *